US006565393B1

(12) United States Patent
Cole

(10) Patent No.: US 6,565,393 B1
(45) Date of Patent: May 20, 2003

(54) RETROFIT ARRANGEMENT FOR ATTACHING LEADS TO COMPRESSOR MOTOR TERMINALS

(75) Inventor: Gregory S. Cole, Ormond Beach, FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 0 days.

(21) Appl. No.: 09/301,347

(22) Filed: Apr. 29, 1999

Related U.S. Application Data

(63) Continuation-in-part of application No. 09/075,211, filed on May 11, 1998.

(51) Int. Cl.[7] ..... H01R 4/50

(52) U.S. Cl. ..... 439/807; 439/756

(58) Field of Search ..... 439/807, 888, 439/863, 801, 815, 792, 756–758, 100, 814, 431, 762, 764–766, 771, 797

(56) References Cited

U.S. PATENT DOCUMENTS

| | | | | | |
|---|---|---|---|---|---|
| 1,537,968 | A | * | 5/1925 | Schnabel | 439/756 |
| 2,429,448 | A | * | 10/1947 | Bakke | 439/792 |
| 3,345,452 | A | * | 10/1967 | Logan et al. | 439/807 |
| 3,447,122 | A | * | 5/1969 | Beck | 439/807 |
| 3,707,698 | A | * | 12/1972 | Robinson et al. | 439/431 |
| 4,223,179 | A | * | 9/1980 | Lusk et al. | 174/73 R |
| 4,521,067 | A | * | 6/1985 | Dufresne | 439/522 |
| 5,062,812 | A | * | 11/1991 | Allen | 439/756 |
| 5,302,143 | A | * | 4/1994 | Inoue et al. | 439/762 |
| 5,803,371 | A | * | 9/1998 | Sugiyama et al. | 239/555 |
| 5,957,733 | A | * | 9/1999 | Mello et al. | 439/814 |

* cited by examiner

*Primary Examiner*—Javaid Nasri
(74) *Attorney, Agent, or Firm*—Crowell & Moring LLP

(57) ABSTRACT

A retrofit arrangement using a non-conductive adaptor body is used to attach leads or lead spade terminations to deteriorated compressor terminals. A secure holding force between the leads or spades attached to the leads and the deteriorated terminals is obtained with a wedging force. A screw is arranged at an angle to the terminal to directly provide the wedging force. The screw can also be of non-conductive material.

19 Claims, 4 Drawing Sheets

RETROFIT ARRANGEMENT FOR ATTACHING LEADS TO COMPRESSOR MOTOR TERMINALS

This application is a continuation-in-part of U.S. patent application Ser. No. 09/075,211, filed May 11, 1998, the disclosure of which is incorporated herein by reference.

BACKGROUND AND SUMMARY OF THE INVENTION

The present invention relates to a body for use with compressor motor terminals, and more particularly, to an arrangement which uses wedging for effectively and securely retrofitting an electrical lead or lead spade termination on a deteriorated compressor terminal.

A conventional hermetically sealed electric motor 10 used for air conditioning compressors and the like typically has three identical terminals 11, 12, 13 arranged in a triangular pattern as seen in FIG. 1*a* and substantially encapsulated in an electrically insulating plug. These types of terminals protrude about ⅜" from the insulating plug and typically consist of a ¼"×1/32" spade welded or brazed to a ⅛" diameter cylindrical pin that passes through the insulating plug. The specific configuration of a known individual terminal, e.g. terminal 11, is shown in FIG. 1*b* and includes the terminal 14 and the welded-on spade 15.

Electrical power is typically supplied to the compressor motor 10 by lead wires with female connections attached to the end that fit over the above-described male-type spade terminals 11, 12, 13. This connection often has poor mechanical contact (thus also poor electrical contact) and causes the terminal to deteriorate through arcing and the like. Part or all of the spade-type connector or terminal 15 (FIG. 1*b*) may be deteriorated to a point where the original female connector can no longer serve its intended purpose. A new adapter is needed that can easily replace the old connection and can be attached to a partially deteriorated terminal without removing the deteriorated terminal because removal of the terminal can damage the hermetic seal due to the fragility of the insulator plug.

Conventional approaches for allowing an electrical lead to be connected to a deteriorated terminal have a number of disadvantages. For example, they do not work well in confined spaces or else require the use of special tooling.

U.S. Pat. Nos. 5,662,502 and 5,857,878, for example, describe an adapter designed to enable an electrical connection to each of the male connectors on a compressor assembly. In particular, a set screw is provided at the bottom of a tube so as to engage a damaged rod or cylindrical pin of the terminal. One problem with this approach is that the set screw connection can be loosened due to vibrations and the like and/or the thread can become stripped because the walls of the tube must be made thin due to terminal spacing restraints and can contain only a few threads. That is, a high drive torque is created by the set screw connection which causes failure of the few threads which are too few and too fine to withstand the torque. Also, we have found that it is unnecessary to provide an adaptor for each connector as typically the only two terminals associated with the run windings become sufficiently deteriorated due to arcing. This is particularly important because off the limited space or "real estate" available on the terminal area.

An object of the present invention is to provide an arrangement which is simple in construction and permits a secure connection to deteriorated connectors on a compressor terminal, and minimizes the number of retrofit connections needed.

Another object of the present invention is to provide a connector which can be used in confined spaces (where adjacent connectors will touch without shorting) and with standard tooling.

A yet further object of the present invention is to provide an arrangement which allows manipulation to attach the lead by access to the front face of the connector rather than the side which has more obstructions present so as to limit convenient accessibility.

Another object of the present invention is to provide an arrangement with a direct electrical connection of the compressor terminal and the lead wire and, without the need for an electrically conductive connector body.

Still another object of the present invention is to provide a connector which achieves improved electrical contact with the terminal and thereby reduces electrical resistance.

Yet a further object of the present invention is to employ an adapter which can be constructed from readily available, inexpensive non-conductive materials.

A still additional object of the present invention is to allow a connector to be securely connected with the terminal without the need to remove any portion of the deteriorated terminal.

This object has been achieved in accordance with the present invention by providing a non-conductive, non-metallic connector body which utilizes a wedging force or action to securely fasten an electrical lead or lead spade termination to a deteriorated compressor run-winding terminal without the need to crimp the lead or deform the connector body in any manner.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

The embodiment of the present invention herein below discussed is based upon the recognition that a wedge force will provide a force-locking fastening of the electrical lead to a deteriorated compressor terminal superior to that of a crimped fastening and the like. That is, the wedge force, when applied to a remaining deteriorated portion of the terminal, forces the terminal against one or more interior sides of the terminal adapter with the electrical lead wedged therebetween.

In a currently preferred embodiment of the present invention, the electrical lead can be inserted through the opening in the top of the connector and pinched into place thereat by the same wedge force which is used to secure the adapter to the terminal. In this version, the adapter does not have to be made of a conductive, deformable metal material because direct contact exists between the terminal and the lead, and there is no deformation of the adaptor body. Of great importance, the use of a non-conductive adapter body precludes the possibility of a short circuit.

Figure 2:
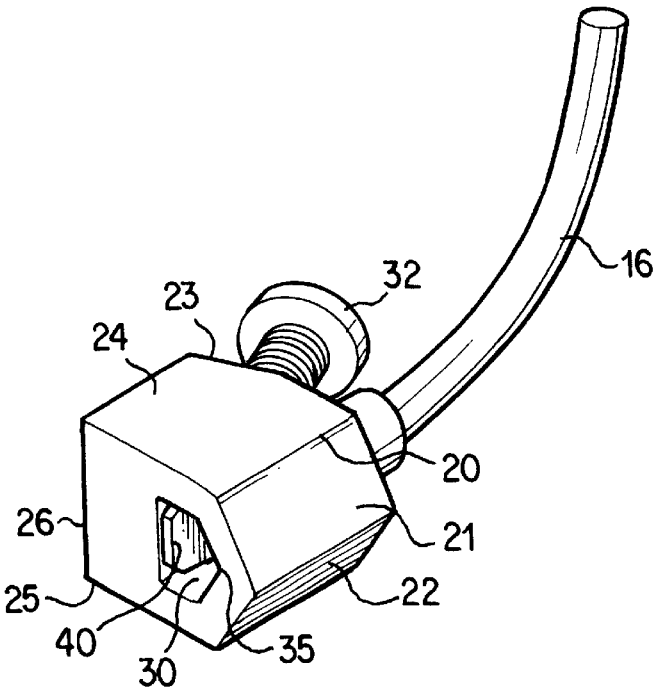
FIG. 2 is a perspective bottom view of the preferred embodiment of a wedging arrangement in accordance with the present invention in which the lead wire has been attached to a male spade connector and inserted into the top of the body.
Figure 6:
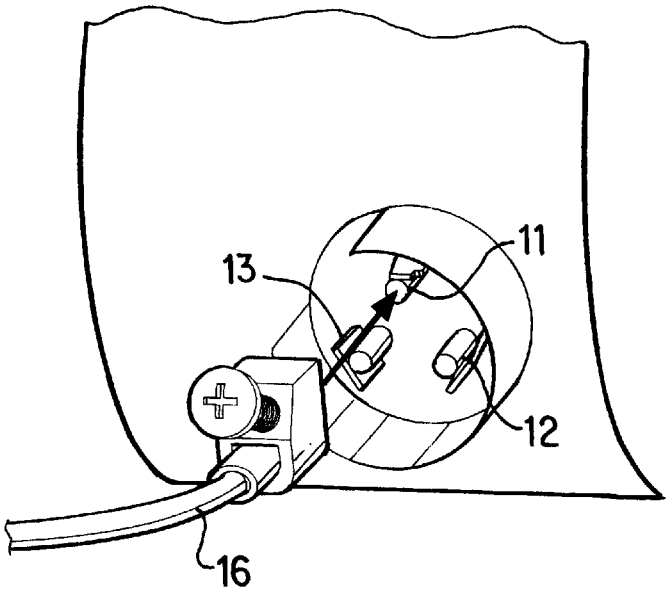
FIG. 6 is an installation view showing the installation of the connector on a compressor spade connector, which spade connector is similar to FIG. 1*a;*

Referring specifically now to FIG. 2, the adapter body 20, can be configured from multiple flat surfaces. Flat surfaces 21, 22 being angled to allow up to three connectors to fit in the tight triangular configuration required by smaller compressors, although in most cases only two connectors are necessary. A flat surface 23 is oriented perpendicular to the axis of a threaded opening 31, so as to facilitate the taping of this opening or hole without wandering of the drill or tap during manufacturing. Rectangular parallel faces 24, 25 facilitate holding of the body during fabrication and assembly. The terminal aperture or opening 30 in the adaptor body 20 is in a form sized to permit passage of the terminal 11, 12, 13 (FIG. 6) and the spade 40 termination on the end of the lead 16.

Figure 1A:
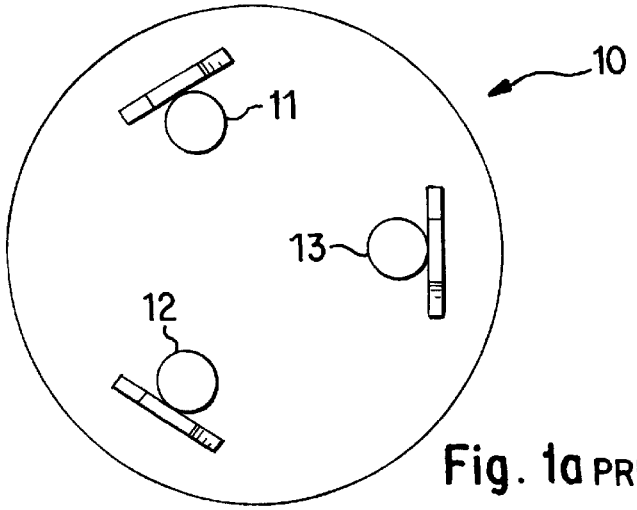
Fig. 1a PRIOR ART
FIGS. 1*a* and 1*b* are, respectively, a top view of the above-discussed conventional compressor terminal configuration with three known male spade-connector terminals and a perspective, isolated view of one such known spade-connector terminal.
Figure 1B:
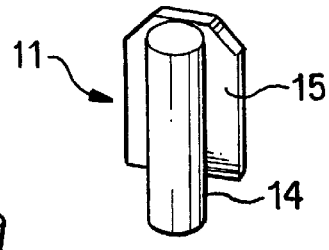
Fig. 1b PRIOR ART
Figure 3A:
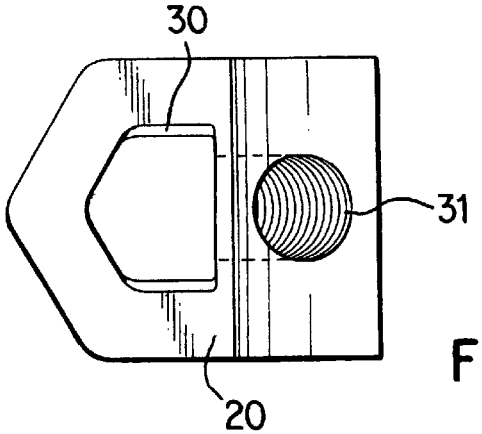
FIGS. 3*a*, 3*b*, and 3*c*, respectively, top, front and side views of the connector body of the preferred embodiment seen in FIG. 2.
Figure 3B:
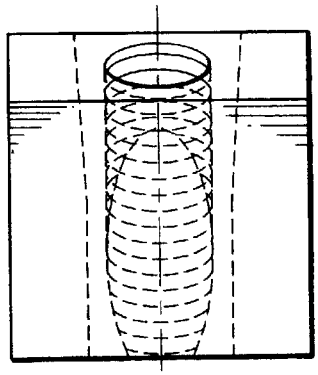
Figure 3C:
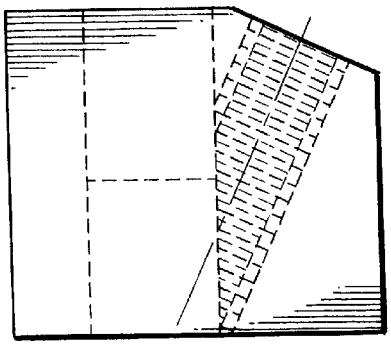
Figure 4:
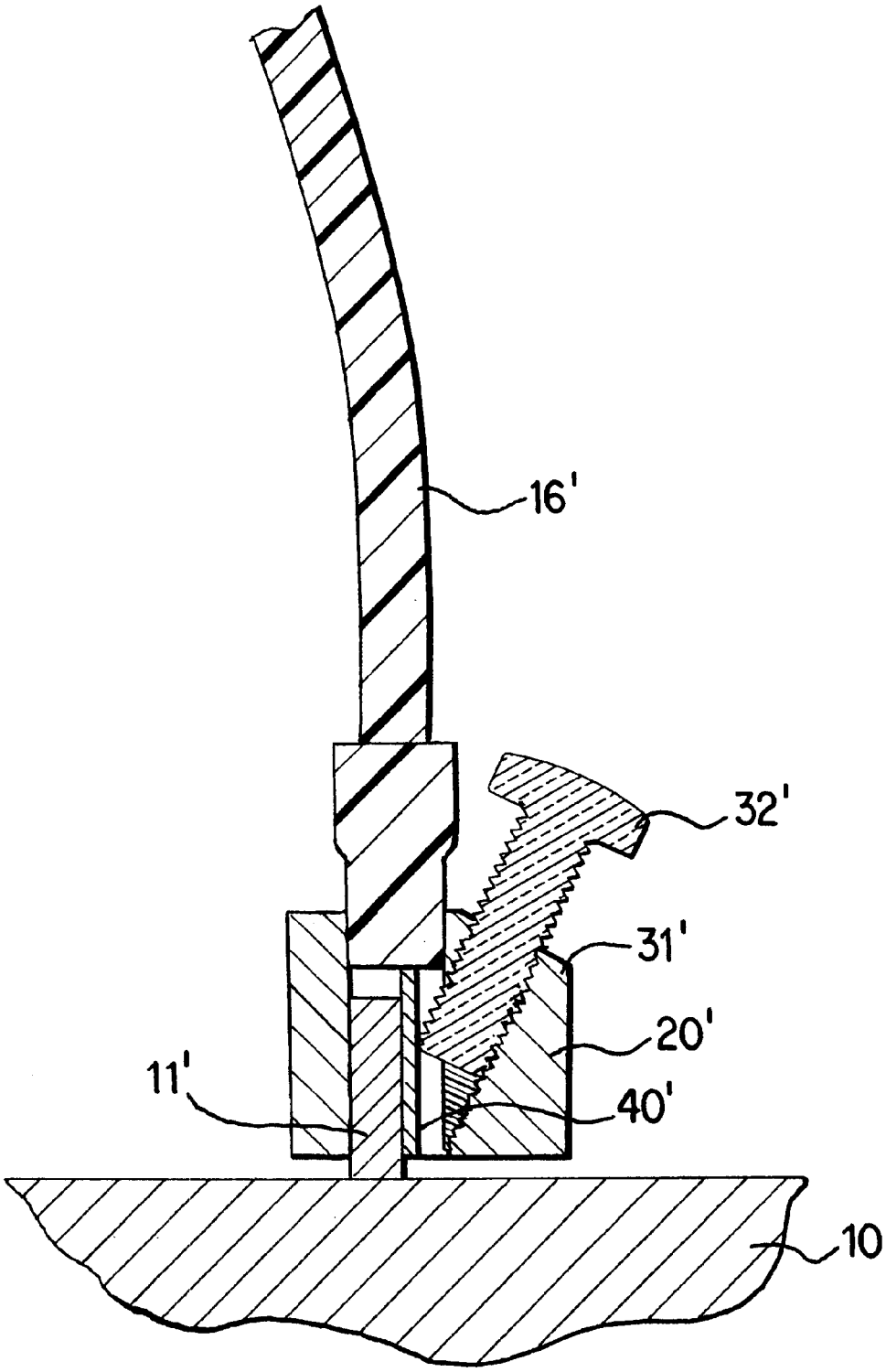
FIG. 4 is an assembled cross-sectional side view of the preferred embodiment, showing the lead wire 16' with a male-spade connector 40' (attached to the end of the lead wire) entering from the top.
Figure 5:
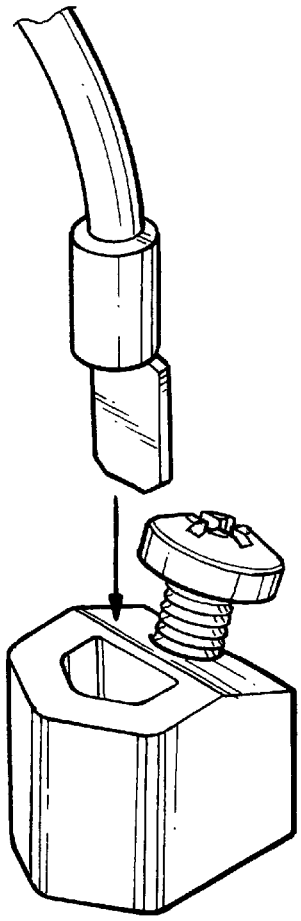
FIG. 5 is a assembled view similar to FIG. 4, but with the male-spade connector removed from the top of the connector.

A tapped hole 31 (FIG. 3) enters through one end of the adapter body 20 at an angle of between about 10° and 30° (25° being used in the illustrated embodiment) to the terminal aperture and is threaded either fully or partially along the extent of the body 20. A screw 32 sized to mate with the tapped hole 31, when screwed into the adapter body 20, wedges the spade 40 on the lead 16 directly against the spade 15 of the type shown in FIG. 1*b*) on the terminal or any remaining portion of the terminal and wedges both the lead and the terminal against the front tapered interior walls 35 of the adapter body opposite the screw 32. The interior opening 30, has an angular or baseball "home-plate" shape with an internal wall 35 which defines a V-shaped notch (i.e., a polygonal opening with two sides angled toward each other) to allow either a complete or severely corroded compressor spade connector to be trapped and wedged into the opening.

Alternatively, the end of the lead wire 16 is placed through the terminal opening 30 at the top into the V-shaped notch, without first being attached to a male spade connector 40. The screw 32 then contacts the terminal 11 and pushes the lead 16 toward the V-shaped notch for a secure connection. If stranded wire is utilized, however, the wedging action of the screw can damage the strands of the wire.

The screw 32 is threaded into the screw hole 31 such that the screw engages the electrical lead 16 directly or the spade 40 on the end of the electrical lead 16, to provide the wedge force which secures the electrical lead 16 or the spade 40 against the terminal, the wedge force simultaneously securing the adapter body 20 to the terminal. The screw 32 need not be made of conductive material, because the electrical lead 16 or the spade 40 is held directly against the terminal. The body 20 can be injection molded from plastic materials such as nylon, polycarbonate, Ultem®, or other suitable electrically insulating material with sufficient strength.

In the currently preferred embodiment of FIG. 2, the opening or pentagon-shaped aperture 30 for receiving the electrical lead 16 is the same opening that receives the compressor terminal. However the opening for receiving the electrical lead could also be located below the screw hole 31 and communicating therewith, extending in a longitudinal direction of the adapter body 20.

To connect the electrical lead 16 to the terminal 11, the following steps are taken: (a) If a conventional spade connector 40 is used, it is first attached to the end of the lead 16; (b) the adapter body 20 is placed over the terminal 11 such that the terminal is received in the terminal opening 30 between the lead spade 40 (or lead 16) and the front of the interior opening 30; and (c) the screw 32 is threaded into the screw hole 31 such that it engages the spade 40 (or electrical lead 16), providing the wedge force which securely holds the electrical spade 40 (or lead 16) between the screw 32 and the compressor terminal 11 which is then wedged into the angular portion 35 of the adapter body 20, the wedge force simultaneously securing the adapter body 20 to the terminal 11.

In the embodiment of FIG. 2, the location and angle of the screw hole 31 are such that the screw 32 will wedge the spade 40 on the electrical lead 16 and the compressor lead 11 securely between the screw 32 and the tapered body portion 35.

An advantage of the present invention is that the assembly or connection operation does not require the removal of any portion of the deteriorated terminal. Another advantage is that access to the terminal adapter can be achieved from the front which is of particular advantage where there is a lack of clearance space.

In addition, the above-described embodiments provide several other advantages which are as follows:

1. The tightening force can be aligned parallel or nearly parallel to the axis of the terminal which is particularly desirable in confined terminal areas.
2. Standard tooling, such as a Phillips-head screwdriver, can be used to fasten the adapter thereby avoiding the need for additional equipment.
3. A screw entering a tapped hole, either parallel to or at a small angle to the terminal, has more material available for the threads to grip than a set screw in a thin-walled conventional adapter. My approach minimizes thread stripping whereas hexagonal head set screws threaded through thin walled materials, where only one or two threads are available due to a thin-wall necessitated by space constraints, tend to strip threads because of a high driving torque created by hexagonal head tooling and a small screw stress area.
4. Forcing the lead directly against the terminal creates better contact and less electrical resistance than current designs which use the adapter body to conduct electricity. Known designs use two connection points (lead-to adapter and adapter-to-terminal) having greater electrical resistance, and this can lead to arcing and connection failure.
5. The wedging action created does not required relative sliding motion between the corroded spade connector on the compressor 11 and the connector of the present invention 20. This is critical because the corroded spade connector is not smooth and relative motion along this corroded surface would be difficult.
6. Forcing the lead directly against the terminal creates an electrical path from the terminal to the wire. Because my adapter body is configured not to be part of the electrical path, it can be fabricated from non-conducting material, thereby preventing short circuits.

7. My invention does not require removal of any of a deteriorated terminal and is not required to be used on all three terminals of the compression. This is particularly important because as little work as possible should be performed on deteriorated terminals inasmuch as further work can damage the plug which hermetically seals the compressor.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A retrofit arrangement for attaching an electrical lead to a terminal, comprising a non-conductive body with top and bottom ends having an aperture passing through said top and bottom ends to form a passage through the body so as to be removably placeable over the terminal to substantially surround the terminal, and a unitary wedging apparatus arranged in a second aperture in the body so as to rotate about an axis oblique to the opening of the aperture at the bottom end and having an edge portion configured to directly contact one of the terminal and the lead at an angle of other than 90 degrees for forming, with only the edge portion, a wedge-shaped engagement configuration and force-locking holding the terminal and lead directly together and against the adaptor body, wherein the axis around which the unitary wedging apparatus rotates passes through the aperture at one of the top and bottom ends.

2. The arrangement according to claim 1, wherein the unitary wedging apparatus is a threaded member adapted to mate with a threaded portion in the adapter body, the threaded portion extending obliquely to a longitudinal axis of the terminal and parallel to the axis about which the unitary wedging apparatus rotates.

3. The arrangement according to claim 2, wherein the threaded member is non-conductive.

4. The arrangement according to claim 1, wherein the lead is a bare wire.

5. The arrangement according to claim 1, wherein the lead is a solder tinned bare wire.

6. The arrangement according to claim 1, wherein the lead includes a spade connector.

7. The arrangement according to claim 1, wherein the body is configured to have the lead enter therein at a top surface thereof.

8. The arrangement according to claim 1, wherein the body has a multi-faced, flat-sided outer configuration and an aperture for receiving the terminal and the lead.

9. The arrangement according to claim 1, wherein the body has a polygonal opening with two sides angled toward one another for receiving the terminal and the lead.

10. The arrangement according to claim 1, wherein the body has an opening configured to receive the terminal and the lead from different ends of the body.

11. The arrangement according to claim 10, wherein the opening is of pentagon configuration.

12. A retrofit arrangement for attaching an electrical lead to a terminal, comprising a non-conductive adapter body with top and bottom ends having a single opening passing therethrough to form a passage for receiving both the terminal and the lead from opposite ends, a unitary screw rotatable about an axis, and an opening in the adapter body for rotatably receiving the screw, wherein said terminal-receiving opening and said screw-receiving opening are arranged at an angle to each other, other than 90 degrees such that the axis about which the unitary screw rotates passes through the opening in one of the top and bottom ends, such that an edge portion of the unitary screw directly contacts against one of said terminal and said electrical lead to provide, with only the edge portion, a wedge force for removably securing the adapter body to said terminal and the electrical lead to effect a direct electrical connection between the terminal and the electrical lead.

13. A method of directly attaching an electrical lead to a terminal, comprising the steps of placing a non-conductive adaptor body with top and bottom ends having a passage therebetween to define first and second apertures at said top and bottom ends so that said body is placeable over and substantially around the terminal, arranging the electrical lead at an angle of about 180° to the terminal and applying a wedge force by moving a unitary threaded member arranged in a third aperture in the adapter body obliquely to the terminal and directly contacting one of the terminal and lead with only an edge of the unitary threaded member for directly holding the terminal and the lead together and against the adaptor body.

14. A method for attaching an electrical member consisting of a lead or an electrical lead spade termination to a terminal, comprising the steps of:

providing a non-conductive adapter body with top and bottom ends having a passage through said top and bottom ends to define first and second apertures, and configured with a V-shaped notch for removably receiving both the terminal and the electrical member, and a third opening located at an angle other than 90 degrees with respect to the first opening for receiving a unitary screw;

inserting the electrical member into the first opening at an angle of about 180° relative to the terminal;

placing the adapter body over the terminal to receive the terminal in the second opening on the bottom end of the adaptor body; and rotating the unitary screw in the second opening such that only an edge portion of the unitary screw is in direct contact with the electrical member to provide a wedge force pressing the electrical member directly against the terminal, thereby pressing both the electrical member and terminal toward the V-shaped notch.

15. The method according to claim 14, wherein the terminal is located between the electrical member and the V-shaped notch.

16. The method according to claim 14, wherein the terminal is located between the electrical member and the screw.

17. A retrofit arrangement kit, comprising an electrical lead for being attached to a terminal, a non-conductive body with top and bottom ends having a passage therethrough to define first and second apertures at said top and bottom ends, respectively, so as to be able to removably place the body over the terminal to substantially surround the terminal, and a unitary threaded wedging apparatus rotatably arranged in a third aperture in the body so as to rotate about an axis oblique to the second aperture and having an edge portion configured to directly contact one of the terminal and the lead at an angle of other than 90 degrees for forming, with only the edge portion, a wedge-shaped engagement configuration and force-locking holding the terminal and lead directly together and against the adaptor body, wherein the axis around which the unitary threaded wedging apparatus rotates is oriented to pass through the second aperture.

18. The kit according to claim 17, wherein the electrical lead is a wire with conventional male spade connector attached thereto.

19. The kit according to claim 17, wherein the angle formed between the electrical lead and the terminal post is greater than 90 degrees and less than 270 degrees.

* * * * *